United States Patent [19]

Doetzer et al.

[11] 4,444,636

[45] Apr. 24, 1984

[54] SYSTEM FOR THE GALVANIC DEPOSITION OF METALS SUCH AS ALUMINUM

[75] Inventors: Richard Doetzer; Klaus Stoeger, both of Nuremberg; Paul Hini, Kosbach; Johann Gehring, Spardorf, all of Fed. Rep. of Germany

[73] Assignee: Siemens Aktiengesellschaft, Berlin and Munich, Fed. Rep. of Germany

[21] Appl. No.: 270,129

[22] Filed: Jun. 3, 1981

[30] Foreign Application Priority Data

Jun. 25, 1980 [DE] Fed. Rep. of Germany ..... 3023827

[51] Int. Cl.[3] ..... C25D 17/02; C25D 7/06

[52] U.S. Cl. ..... 204/206; 204/207

[58] Field of Search ..... 204/206, 207, 208, 209, 204/210, 211

[56] References Cited

U.S. PATENT DOCUMENTS

| | | | |
|---|---|---|---|
| 1,590,599 | 6/1926 | Taylor | 204/207 X |
| 2,445,675 | 7/1948 | Lang | 204/209 |
| 3,267,008 | 8/1966 | Smith et al. | 204/28 |
| 3,474,009 | 10/1966 | Wang | 204/35 |
| 3,592,746 | 7/1971 | Hespenhaide | 204/206 X |
| 3,658,680 | 4/1972 | Combe et al. | 204/206 |
| 3,661,752 | 5/1972 | Capper et al. | 204/206 |
| 3,778,355 | 12/1973 | Johnson et al. | 204/28 |
| 3,865,701 | 2/1975 | Borgmann | 204/28 |

FOREIGN PATENT DOCUMENTS

| | | | |
|---|---|---|---|
| 813621 | 9/1951 | Fed. Rep. of Germany | 204/206 |

*Primary Examiner*—Howard S. Williams
*Assistant Examiner*—Theodore L. Williams
*Attorney, Agent, or Firm*—Hill, Van Santen, Steadman & Simpson

[57] ABSTRACT

A system for the galvanic deposition of aluminum incorporating a tubular cell through which goods to be treated can be moved in the axial direction. An electrolyte is pumped through the tubular cell preferably with the aid of an electrolyte circulating system which is self-contained. The electrolyte is gated out by means of T-shaped connecting components which are adjoined by airlock arrangements associated with the tubular cell.

18 Claims, 13 Drawing Figures

SYSTEM FOR THE GALVANIC DEPOSITION OF METALS SUCH AS ALUMINUM

BACKGROUND OF THE INVENTION

The invention relates to a system for the galvanic deposition of metals, in particular aluminum, from aprotic, organo-aluminum electrolytes which are free of oxygen and of water, with an aluminum cell for goods in the form of wire, tubes, strips and the like which cell can be sealed from the exterior and which also can be supplied with a shield gas.

Electrolysis systems for the electroplating of goods in the form of wire strips are known in which the goods to be treated are conducted through an electroysis bath in perpendicular loops. For example, the German OS No. 15 21 076 discloses a device for the electroplating of a string of synthetic resin material wherein such string, to which a conductive coating has previously been applied, is conducted through an electrolysis bath in a plurality of loops with the aid of drive rollers and contacting rollers arranged above and guide rollers arranged below, where perpendicular anode plates arranged parrallel to the course of the string are provided in the electrolysis bath. A system of this kind is neither provided nor suitable for the galvanic deposition of aluminum since aluminization requires the use of an electrolyte which is produced under oxygen-free and water-free conditions and must be maintained under these conditions as far as is practically possible. Since the amount atmospheric oxygen and atmospheric moisture present is generally inversely proportional to the conductivity and life duration of these relatively costly electrolytes, air must be excluded to the maximum feasible extent from the electrolytic bath during the galvanic aluminization. Such a system must then be operated in a shield or inert gas atmosphere and the goods or material which are to be treated must be input and output via airlocks in order to suppress the entry of air and moisture to the electrolysis bath as far as possible.

Furthermore, the known systems can only process strip-like and string-like material which can be deflected (bent) even in the untreated state. However, there exist strip-like and string-like materials which must not be deflected in their untreated state, for example light waveguides.

BRIEF SUMMARY OF THE INVENTION

More particularly, the present invention provides an apparatus for the galvanic deposition of aluminum which is especially well adapted for the aluminization of elongated objects or materials in the form of wire, tubes, strips, and the like.

An elongated tubular member or cell is employed which is provided at its opposite ends with airlock arrangements which permit such an elongated material to be moved longitudinally through the cell and each of the airlock arrangements with the cell holding an organo-aluminum electrolyte which is thus substantially sealed from exterior air and moisture by the airlocks. The electrolyte is preferably circulated continuously through the cell by pump means and is deflected within the cell at opposing end portions thereof transversely from its longitudinal cellular flow path by connecting components which are preferably T-shaped and associated with the respective air lock arrangements.

A principal aim of the present invention is to provide a system of the type above and herein described wherein a strip-like or string-like material need not be deflected during an aluminization process.

A further aim is to achieve an aluminum deposition rate which is as high as possible, thus resulting in acceptable strip lengths and exposure times. This aim is realized in accordance with the present invention in that the type of aluminization cell herein employed comprises a tubular cell through which a material which is to be aluminized can be moved, preferably continuously, in an axial direction, and wherein an airlock arrangement is located at each opposed end of such tubular cell. Each such airlock arrangement on one side thereof substantially prevents the penetration of atmospheric air into the tubular cell and on the opposite side thereof permits a flowing thereinto of an electrolyte out of such tubular cell.

A further aim of the invention is to provide an aluminization system having the capacity to provide a substantial increase in the flow density over the prior art. Thus, a reduction in the exposure time can be achieved in that an electrolyte can be pumped through the tubular cell with the aid of a closed electrolyte circulating system, preferably in a direction opposite to that of the movement of the material or goods which is to be treated. The joulean heat which is continuously released with the flow density can thus be discharged particularly effectively.

Other and further aims, objects, purposes, advantages, uses, and the like for the present invention will be apparent to those skilled in the art from the present specification taken together with the drawings.

BRIEF DESCRIPTION OF DRAWINGS

The accompanying drawings illustrate an exemplary embodiment of this system in detail.

DETAILED DESCRIPTION

Figure 1:
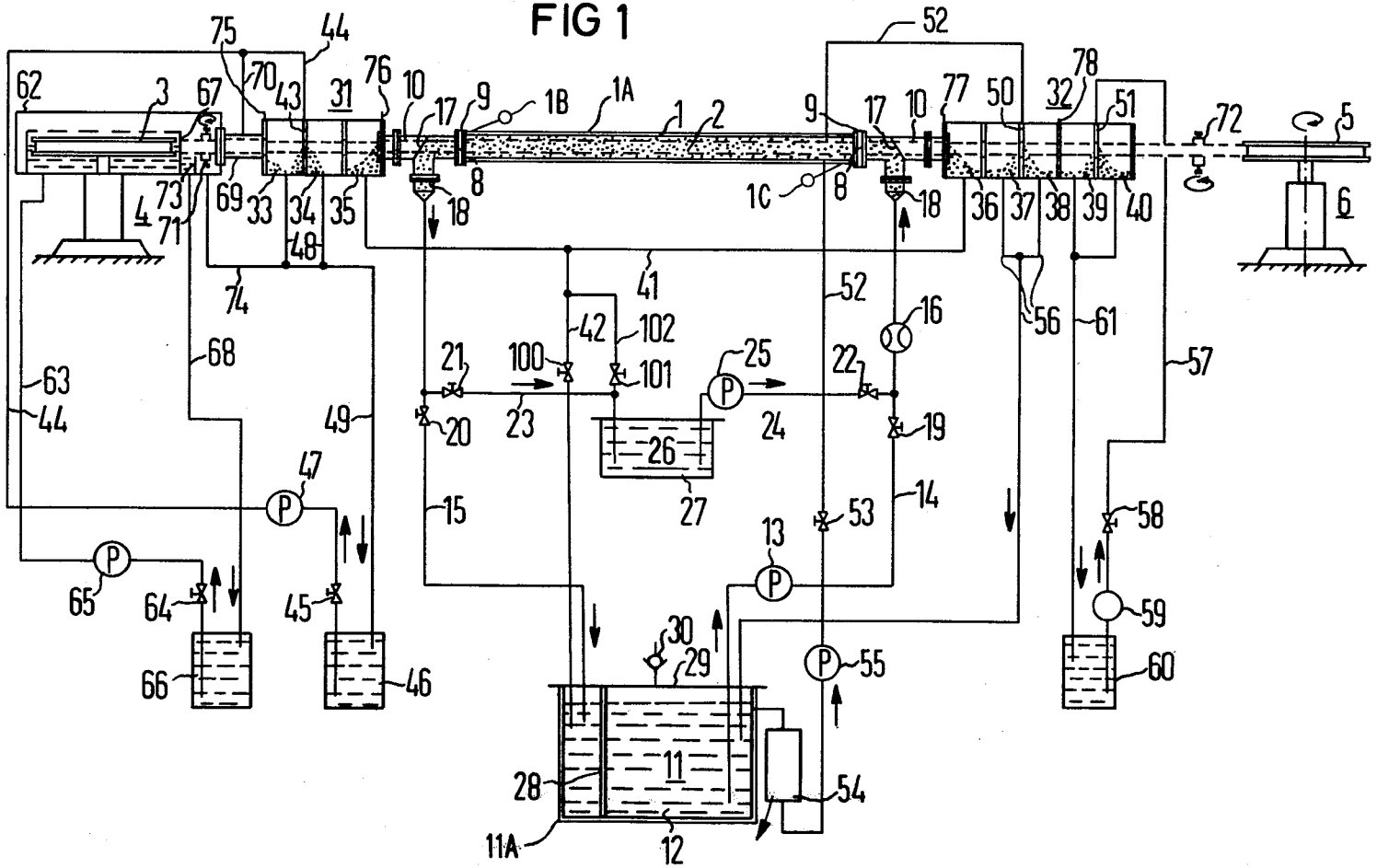
FIG. 1 diagramatically illustrates one embodiment of a system for galvanic deposition of this invention.

A particularly effective technique for solving the prior art problems is achieved herein by employing in the present invention connecting components which are preferably T-shaped and which serve to gate out and deflect the direction of movement of a flowing electrolyte with respect to the deposition cell. These connecting components are placed in combination with the tubular cell and the airlock arrangements. Such preferably T-shaped connecting components are configured and constructed to be as favorable as possible with regard to the flow so that the damming resistance suffers as little as possible.

Such T-shaped connecting component contains an interior diaphragm or interior wall configuration which substantially prevents a longitudinal passage of an electrolyte and which deflects the electrolyte flow preferably at right angles. Such a component preferably possesses a longitudinal opening or passageway which is closely matched to the cross-sectional shape of the elongated material which is to be treated.

In order to achieve a good longitudinal sealing action, it is advantageous for such a longitudinal opening in the interior diaphragm to be defined by a channel which preferably extends over the entire longitudinal length of the connecting component and whose inside transverse dimensions are matched to the cross-section of the elongated material or goods to be treated. The part of the channel which extends forwardly of the diaphragm possesses a wall thickness as required for stability while the part of the channel which extends rearwardly of the diaphragm is matched to its inside width of the associated connecting component.

In accordance with a further development of the invention, each airlock arrangement consists of a plurality of chambers, the transverse walls of which possess openings through which may be conducted the elongated material or goods to be treated. The chambers are sealed from one another by means of inert gas and/or inert liquid.

It is expedient for such openings in the chamber walls to be provided with tubes which are matched to the cross-section of the material or goods which are to be treated and which can be flooded with inert gas and/or inert liquid.

In accordance with the invention, the tubular ends of the preferably T-shaped connecting components are connected via pipelines to an electrolyte feed container or reservoir, and the electrolyte is circulated with the aid of a circulating pump. In a closed cycle of this kind, it is possible to produce an advantageously high electrolyte flow rate in the aluminization cell with the aid of such a circulating pump. An increase in the deposition speed can also be achieved when both the tubular cell and the electrolyte feed container are provided with a heating unit. The flowability of the electrolyte increases within limits in proportion to the extent of such heating which property can be advantageously exploited in the attainment of rapid aluminization.

Preferably, all the components which are connected to the electrolyte and to the electric field consist of non-conductive material, or at the least the surface of such components is electrically insulated.

In accordance with a further development of the invention, the tubular cell, together with the preferably T-shaped connecting components, is arranged perpendicularly so as to permit a perpendicular orientation and transit of the elongated mateial or goods which are to be aluminized in the tubular cell.

The strip aluminization system illustrated in FIG. 1 possesses an internally insulated tubular cell 1 through which is drawn a strip 2 which is to aluminized and which is drawn from a roll 3 in an uncoiling unit 4 and is wound onto a roll 5 in a coiling unit 6 following aluminization. Strip-like anodes 7 are arranged inside the tubular cell 1 on both sides of the strip 2, as shown in particular by FIG. 2*a*. The strip-like anodes 7 are contacted by means of contacting pins 8 which are arranged in annular anode holders 9, as can be seen in detail from FIG. 2*g*. In the exemplary embodiment illustrated in FIG. 1, the anode holders 9 are arranged at the opposed ends of the tubular cell 1 and flush with the flange of the tubular cell 1. In the case of tubular cells which are longer than cell 1, it is expedient to arrange at least one further anode holder 9 with contracting pins 8 within the tubular cell 1 (not detailed).

At the opposed ends of the tubular cell 1, and, in fact, following the anode holders 9, are flange-attached T-shaped connecting components 10 with the aid of which the electrolyte 11 can be pumped and thus circulated out of the electrolyte feed reservoir container 12 through the tubular cell 1 in a direction opposite to that of the movement of the strip 2, such pumping being accomplished by means of a pump 13 and interconnecting pipelines 14 and 15. The electrolyte flow rate can be measured by means of a flowmeter 16.

Figures 2, 2A, 2B, 2C, 2D, 2E, 2F, 2G:
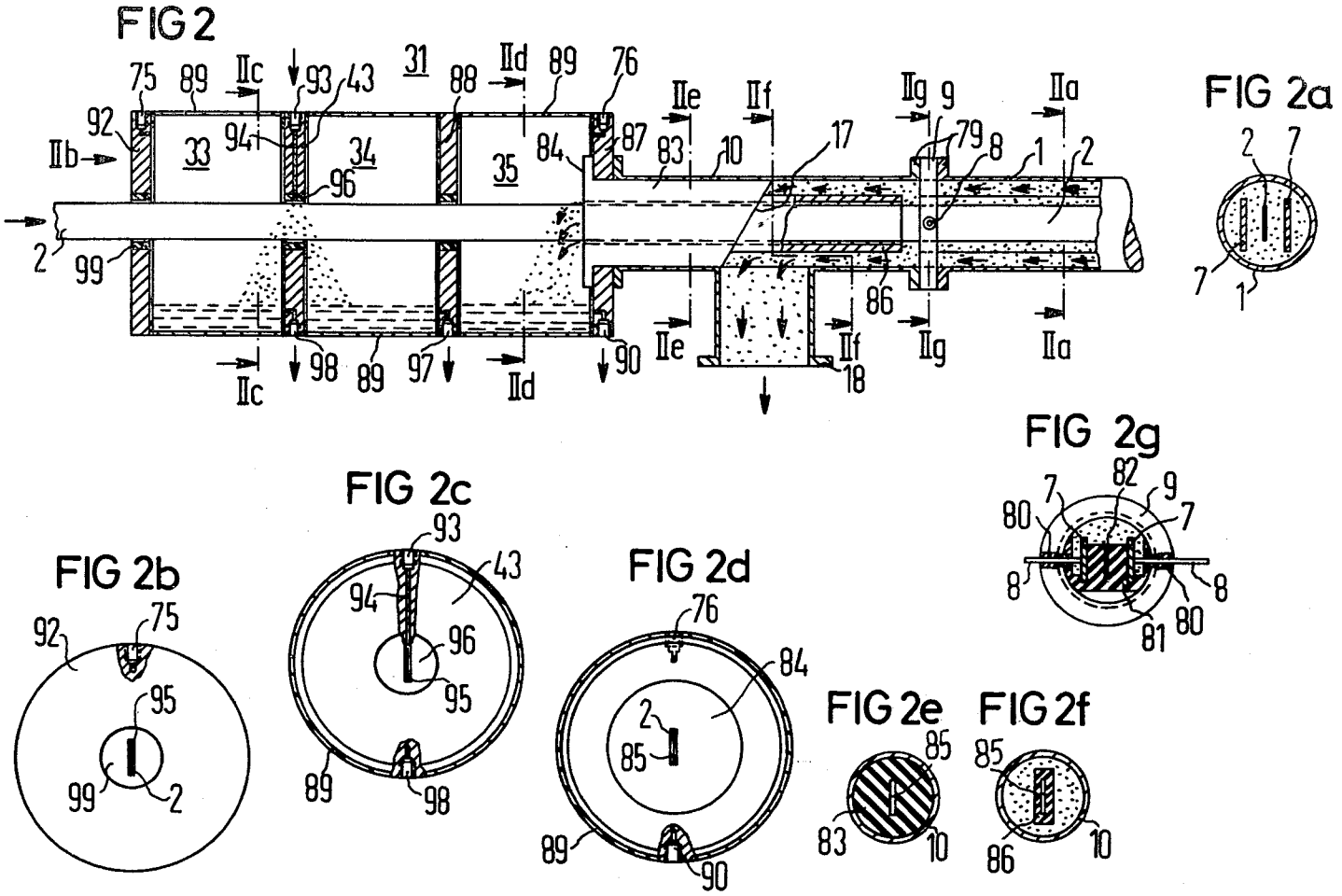
FIG. 2 is a longitudinal sectional view through a tubular cell employed in the system of FIG. 1, such cell having a T-shaped connecting component and an airlock arrangement.
FIG. 2*a* is a vertical sectional view taken along the line II*a*—II*a* in FIG. 2.
FIG. 2*b* is an elevational view of an airlock arrangement taken in the direction and at the position of the arrow II*b* in FIG. 2, some parts thereof being broken away and some parts thereof being shown in section.
FIG. 2*c* is a vertical sectional view taken along the line II*c*—II*c* of FIG. 2.
FIG. 2*d* is a vertical sectional view taken along the line II*d*—II*d* of FIG. 2.
FIG. 2*e* is a vertical sectional view taken along the line II*e*—II*e* of FIG. 2.
FIG. 2*f* is a vertical sectional view taken along the line II*f*—II*f* of FIG. 2.
FIG. 2*g* is a vertical sectional view taken along the line II*g*—II*g* of FIG. 2.

The T-shaped connecting components 10 are each provided with a diaphragm having an oblique interior face 17 adjacent cell 1 in order to deflect the electrolyte which enters and is discharged via connecting pieces 18 connected at an angle of 90° in as favorable as possible a fashion as regards the flow, thus forming an enclosed electrolyte flow loop which, however, can be broken, for example, by means of the valves 19 and 20 when the tubular cell 1 is set in operation. In this case, inert liquid 26 can be pumped and thus circulated from an inert liquid feed reservoir container 27 through the tubular cell 1, the connecting components 10, and the pipelines 24 and 23 by means of a conveyor pump 25 in the cell input pipeline 24, when the valves 22 and 21 are each open, in order to remove atmospheric air from the tubular cell 1 before the electrolyte 11 is pumped therethrough. Advantageously, the electrolyte flowing through the pipeline 15 in the direction of the arrow shown in FIG. 2 is not directly introduced into the electrolyte feed container 12, but only after passing through a filter 28 in order to be able to separate impurities in the electrolyte 11 which are in the form of solid particles.

The electrolyte feed container 12 is sealed so as to be airtight by means of a hatch cover 29. The electrolyte feed container 12 is also equipped with a pressure relief valve 30 and with corresponding openings, sealed so as to be air-tight, through which the pipelines 14 and 15 are introduced. The electrolyte feed container 12 is also adapted to be provided with a shield or inert gas atmosphere.

For the passage of the strip 2, the interior faces 17 of the T-shaped connecting components 10 are provided with appropriate openings, and these openings are matched as closely as possible to the cross-sectional configuration of the strip 2 in order to avoid as far as possible an emergence of electrolyte from the tubular cell 1 or from the T-shaped connecting components 10, and also to minimize the penetration of atmospheric air into tubular cell 1. As, however, this is only partially possible, airlock arrangements 31 and 32 are provided at the respective opposite ends of the tubular cell 1 and its adjoining connecting components 10. In accordance with FIG. 1, the airlock arrangement 31 possesses three chambers 33 to 35 whereas the airlock arrangement 32 possesses five chambers 36 to 40. In chambers 35 and 36 of the respective airlock arrangements 31 and 32, the electrolyte emerging through the openings in the interior faces 17 is collected and is returned via pipelines 41 and 42 to the electrolyte feed container 12 preceding the filter 28.

It has proved especially advantageous for the airlock arrangements 31 and 32 to possess liquid airlocks which are particularly well sealed and which even prevent the diffusion of atmospheric air into the tubular cell 1.

An effective liquid airlock can be formed, for example, in the chambers of the airlocks arrangements 31 and 32, which are preferably composed of tubular components and partition walls. Each is partially flooded with an inert liquid as will be explained in detail with reference to FIG. 2. In the exemplary embodiment illustrated in FIG. 1, a disc-like partition wall 43, which is provided with an opening through which the strip 2 passes, is further provided with a bore which leads to said opening, and to which is connected a pipeline 44 which leads via a valve 45 to an inert liquid container 46. With the aid of a pump 47, the inert liquid is conducted to the opening in the partition wall 43, so that the space between the strip 2 and the opening is entirely filled. The inert liquid which emerges from the gap between the strip and the opening is collected in the chambers 33 and 34 and then returned to the inert liquid container 46 via pipelines 48 and 49.

The partion walls 50 and 51 of the respective airlock chambers 37, and 38, and 39, and 40, are designed in the same way as the partition wall 43 between the two chambers 33 and 34 of airlock arrangement 31, and an axial connecting bore through the disc-like partition wall 50 is connected to an electrolyte distilling unit 54 via a pipeline 52 and a valve 53. This loop includes a conveyor pump 55 with which the inert liquid obtained from the electrolyte 11 as a result of distillation (vaporization and subsequent condensation can be pumped via a radial bore (not shown) in the partition wall 50 (similar to bore 94 in wall 43) into the space between the strip 2 and the connecting bore. The inert liquid which accumulates in the chambers 37 and 38 of the airlock arrangement 32 is returned via pipelines 56 to the electrolyte feed container 12. The function of this inert liquid cycle is mainly to cleanse and remove loose material including adhering Al electrolyte by means of an inert liquid flush.

This is extremely important in order to have the system undisturbed and to enhance a maximum length of operation therefor. Constancy of the electrolyte as regards composition and quality, and a minimum of electrolyte loss as a result of discharge with coated material, constitute extremely important operational factors. The system which contains the electrolyte distilling unit 54 takes into account both these factors.

Only a small volumetric quantity of inert liquid amounting to a few liters is ever discharged from the cycle as a result of condensation or distillation from the large electrolyte feed supply for this flushing and washing process. This quantity can be returned to the electrolyte feed container 12 containing relatively small amounts of flushed original electrolyte. Consequently, the composition and the amount of the electrolyte in the feed container 12 both remain virtually constant. At the same time, the quantity of electrolyte discharged through the strip 2 which is to be coated is reduced to a minimum. The flushing of the surface of the strip 2 with a pure inert liquid represents a highly effective cleansing thereof of adhering electrolyte.

The minimal residues of highly diluted electrolyte which may remain on the surface of the strip 2 having emerged from the chamber 38 are then entirely eleminated from the feed container 60 in the chambers 39 and 40 by means of the partition wall 51 and inert liquid from the nozzle.

The discharge of a small volumetric components of inert liquid from the overall electrolyte supply, for the purpose of flushing original electrolyte from the surface of aluminized work pieces back into the electrolyte feed container 12, represents an extremely important and effective feature of the system in accordance with the invention.

Correspondingly, the disc-shaped partition wall 51 is connected to a pipeline 57 which is connected via a valve 58 and a pump 59 to a further inert liquid container 60. The inert liquid is returned from the chambers 39 and 40 via a pipeline 61.

The roll 3 of the uncoiling unit 4 is likewise contained in a closed container 62 which is supplied with an inert gas such as $N_2$ and is partially filled with inert liquid. The container 62 is connected to an inert liquid container 66 via a pipeline 63, a valve 64 and a conveyor pump 65. The container 62 contains an overflow 67 for the inert liquid. At the rear of the overflow 67, there is arranged a discharge pipelines 68 which returns the overflowing inert liquid into the inert liquid container 66.

The container 62 is also connected to the airlock arrangement 31 in a sealed fashion via a tubular connecting component 69. The connecting component 69 likewise possesses a longitudinal opening for the strip 2 which is to be aluminized and can be connected by means of a pipeline 70 to the pipeline 44 of the inert liquid cycle of the airlock arrangement 31.

The strip 2 is contacted via contacting rollers 71 and 72 arranged on both sides of the strip 2. For clarity herein, only one contacting roller has been indicated which is connected to the negative pole of a current source.

As can be seen from FIG. 1, the contacting rollers 71 are arranged inside the container 62 and are separated by a partition wall 73. By means of a pipeline 74 which is connected to the pipeline 49, excess inert liquid can be discharged into the inert liquid container 46.

Connecting components 75, 76 and 77, 78 of the airlock arrangements 31 and 32 allow connection to an inert gas feed container which has not been shown in the drawings for clarity. This connection is effected via appropriate valves (not detailed).

FIG. 2 is a longitudinal section through the airlock arrangement 31, the T-shaped connecting component 10, the anode container 9, and a part of the tubular cell 1. FIGS. 2*a* through 2*g* show various vertical sectional views of FIG. 2 in which identical components have been provided with like references.

As can be seen from FIG. 2*a*, in the selected exemplarly embodiment anodes 7 which are higher than the width of the strip 2 are arranged on both sides of the strip 2 which is to be aluminized. The tube interior is entirely filled with electrolyte. In this embodiment, the strip 2 is fully aluminized on both sides. If any parts of the strip are not to be covered with a layer of aluminum, these parts must be covered, for example, by the insertion of an appropriately shaped body into the interior of the tubular cell 1, so that only those parts of the strip which are free of the appropriate cover are aluminized.

As can be seen from FIG. 2 and 2*g*, the anode container 9 is formed in a ring configuration and is arranged between the connecting flanges 79 of the tubular cell 1 and the T-shaped connecting component 10. As shown in FIG. 2*g*, the contacting pins 8 lead through insulated openings 80 to the anode 7 and press these against a matingly configured anode carrier 81 consisting of insulating material. The anode carrier 81 is provided with a corresponding recess 82 for the strip 2 and also serves to guide said strip.

As can be seen from FIG. 2, the internally insulated T-shaped connecting component 10 can consist of a T-shaped tube which possesses about the same diameter as the tubular cell 1. The interior face 17 is formed by a non-conductive insert 83 and has a flange 84 inserted into the connecting component 10, so that the oblique surface thereof forms the actual diaphragm. A curved surface can alternatively be used in place of an oblique surface. That part of the insert 83 located at the rear of such a surface entirely fills the intermediate component 10 and possesses an opening 85 which preferably narrowly matches the strip cross-section through which the strip 2 passes. However, this opening 85 extends over the entire length of the insert 83, and, prior to the interior face 17, the opening 85 is surrounded by a tubular component 86 which as illustrated in FIG. 2*f*, is here generally rectangular in cross section. The wall thickness of the component 86 is just sufficient to enable the electrolyte to flow freely yet is chosen so as to ensure that the component 86 maintains the requisite stability.

The insert 83 is tightly inserted in the connecting component 10. Between the flange 84 of the insert 83 and the flange of the connecting component 10 there is arranged a disc-shaped wall component 87 of the airlock arrangement 31 which component 87 is provided with the connecting piece 76 for delivering the inert gas, such as $N_2$ (see FIGS. 3 and 4 and accompanying specification text).

The connecting piece 76 is connected via a bore (not shown) to the chamber 35 which is formed by a further disc-shaped wall component 88 and a tubular component 89. The disc-shaped wall component 87 also possesses a connecting piece 90 which serves to connect the pipeline 42 shown in FIG. 1. The electrolyte emerging from the connecting component 10 through the gap between the strip 2 and the opening 85 can accumulate in the chamber 35 and then flow via the connecting piece 90 and pipelines 41 and 42 to the electrolyte feed container.

The chamber 34 of the airlock arrangement 31 is formed by the wall components 43 and 88, whereas the chamber 33 is formed by the wall component 43 and a wall component 92. The two chambers 33 and 34 serve to collect the inert liquid which is fed via a connecting piece 93 and via a radial bore 94 to an opening 95 in a non-conductive, disc-shaped part 96. The connecting piece 93 is connected to the pipeline 44 shown in FIG. 1 through which, by means of the pump 47, inert liquid is conducted through the channel 94 into the gap between the inserted strip 2 and the opening 95 in such a manner that this gap is entirely filled with inert liquid. This results in a 100% seal from atmospheric air. The inert liquid which accumulates on the base of the chambers 34 and 33 is discharged via connecting pieces 97 and 98. The pipelines 48 are connected to pieces 97 and 98 through the pipeline 49 that extends into the inert liquid container 46. As can be seen from FIG. 2, the connecting pieces 97 and 98 are connected to the chambers 33 and 34 via bores. The wall component 92 contains the connecting piece 75 which can be supplied with inert gas such as $N_2$ so that apart from the inert liquid and the electrolyte, the chambers 33, 34, and 35 contain only inert gas.

The non-conductive, disc-like shaped component 96 can be arranged in the disc-like partition wall 43 so as to be exchangeable. Thus, it can be replaced by another disc-like component, if necessary. In order to achieve longer gap paths between the strip 2 and opening 85, the disc-like shaped component 96 can be replaced by a cylindrical component which is provided with a channel matched generally to the cross-section of the strip 2. This results in a wider liquid airlock.

As can be seen in particular from FIG. 2*b*, the wall component 92 is also provided with a disc-like shaped component 99 which contains an opening 95 for the strip 2.

The airlock arrangement 32 is constructed in the same way as the airlock arrangement 31 illustrated in FIG. 2 from disc-like wall components and tubular components. It can be seen that, if necessary, more than three chambers can be used. The more chambers, the better the protection as regards the penetration of atmospheric air.

The tubular cell 1 and the electrolyte feed container 12 can expediently be enclosed by respective heating jackets 1A and 11A as shown in FIG. 1 in order to achieve higher deposition rates by the use of a heated electrolyte. Preferably thermometers 1B and 1C as shown in FIG. 1 are arranged at opposite ends of the tubular cell 1 in order to measure temperature differences which occur in the flow direction and to compensate for these, if present, by an appropriate heating of the heating jacket.

As already noted, the electrolyte can be circulated at any desired flow speed via the two T-shaped connecting components so that the current density can be selected to be substantially higher than in the case of a stationary electrolyte. Thus, higher deposition rates can be attained. Furthermore, the two T-shaped connecting components can advantageously be used to flood or flush the tubular cell with a suitable solvent. Flushing is effected with the aid of the inert liquid 26 in the inert liquid feed container 27 after the closing of the valves 19 and 20 and the opening of the valves 21 and 22 by means of the circulating pump 25. As inert liquid thereby reaches the chambers 35, 36, this liquid must be returned to the container 27 through the pipelines 41 and 102 by the closure of the valve 100 and opening of the valve 101.

The cover of the electrolyte feed container 12 can contain bores through which appropriate devices can be inserted for the measurement of temperature and conductivity and for the provision of a level of display.

To enable the electrolyte to be safely heated for the purpose of improving its flowability, it is expedient to surround the electrolyte feed container 12 by an oil heating jacket container which contains heating coils which thus facilitate an indirect heating of the electrolyte which is harmless to the electrolyte liquid.

The inert liquid preferably consists, for example, of toluene which can be obtained by distillation from the electrolyte which consists of aluminum alkaline complex salt dissolved in toluene.

The electrolyte preferably consists of about 3 to 4 moles of inert liquid and about 1 mole of such an aluminum alkaline complex salt so that the inert liquid, toluene, can be distilled relatively easily from the aluminum alkaline complex salt at a boiling point of about 110° C., whereby toluene (inert liquid) which is entirely free of oxygen and water is obtained which is highly suitable to be used as an inert liquid for the production of a new electrolyte and also for use in the container 60.

The principle in accordance with the invention can also be used whenever, for production technical reasons, galvanization must be carried out not horizontally but vertically. This is necessary, for example, in the galvanic aluminization of light waveguides because, on the one hand, such can only be drawn in a vertical process, and, on the other hand, such must be afforded protection directly following production. It is not possible to deflect or to wind the light waveguides, and subsequently to varnish or galvanize them, in a horizontal position, on account of the high sensitivity as regards their mechanical stability.

Figure 3:
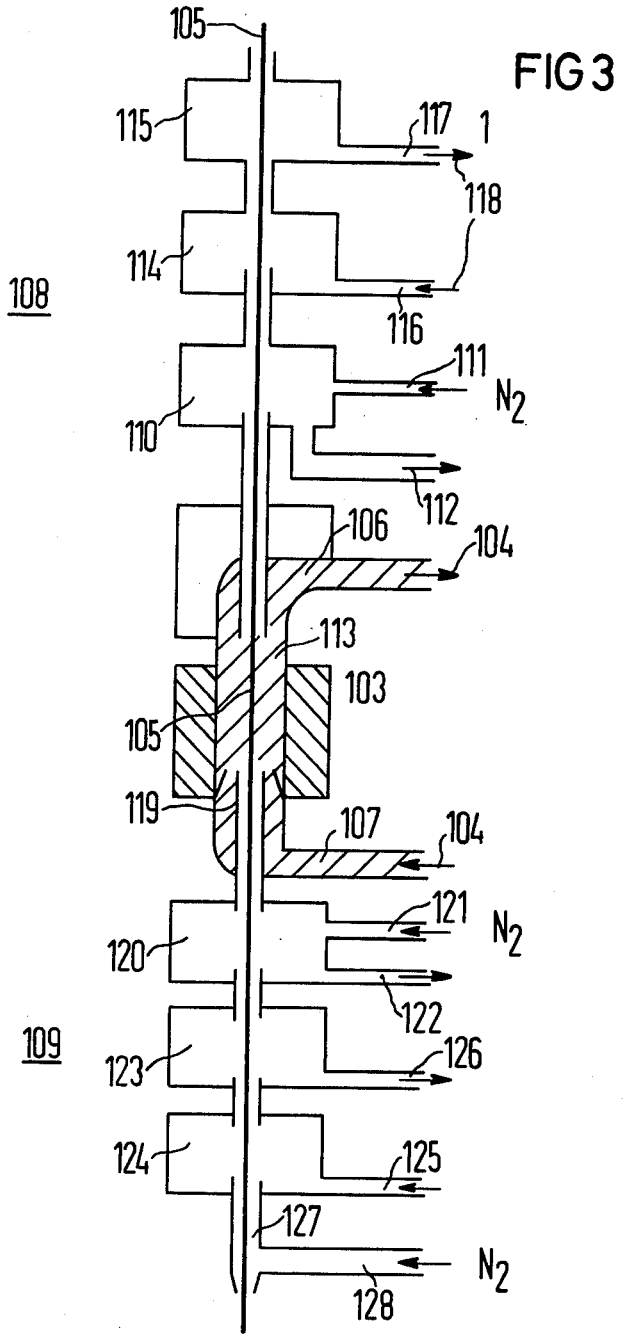
FIG. 3 illustrates schematically one embodiment of a vertical through-flow aluminization cell.

FIG. 3 schematically illustrates an exemplary embodiment of an aluminization of the invention employing a vertical procedure. The actual aluminization cell, which is operationally similar to that in FIG. 1, consists of a tubular cell 103. A string-like material 105 is fed thorugh the tubular cell 103. On both sides of the aluminization cell 103 are flanged attached T-shaped connecting components 106 and 107 in order to supply, discharge and deflect the aluminum electrolyte as indicated by the arrows 104. The connecting components 106 and 107 are flooded by airlock arrangements 108 and 109. The airlock arrangement 108 contains an inert gas chamber 110 which is supplied with an inert gas, for example, $N_2$, through a supply pipeline 111. By means of a connecting conduit 112, any electrolyte 113 still emerging at the top and possibly inert liquid can be discharged and fed to the electrolyte feed container in accordance with the exemplary embodiment illustrate in FIG. 1. The inert chamber 110 is followed by the chambers 114 and 115 which can be flooded with inert liquid via an input 116 and an output 117. These two chambers 114 and 115 prevent air and moisture from penetrating into the galvanization cell 103. Here, the inert liquid is conducted upwards as indicated by the arrows 118. The chambers operate in accordance with the overflow principle.

The T-shaped connecting component 107 is specially designed to prevent the electrolyte 113 from escaping downwards through the inlet openings for the string 105 which is to be aluminized. This is achieved by supplying the electrolyte 113 at a high speed to the aluminization cell 103. The flow is controlled in such manner that a certain underpressure occurs in pipeline 119 and is compensated for by an inert gas (e.g. nitrogen). For this reason, the T-shaped connecting component 107 is adjoined by an inert gas chamber 127 of the airlock arrangement 109. Inert gas is supplied via a connecting conduit 121. Through a connecting conduit 122 any electrolyte 113 still emerging in the pipeline 119 can be discharged and conducted to the electrolyte feed container 11. The inert gas chamber 120 is adjoined by the two inert liquid chambers 123 and 124, input taking place via a connecting conduit 125, and output taking place via a connecting conduit 126. These two chambers 123 and 124 likewise operate in accordance with the overflow principle. Furthermore, a tubular component 127 (to be sealed with inert gas) can be subject to inert gas pressure via a connecting conduit 128.

Figure 4:
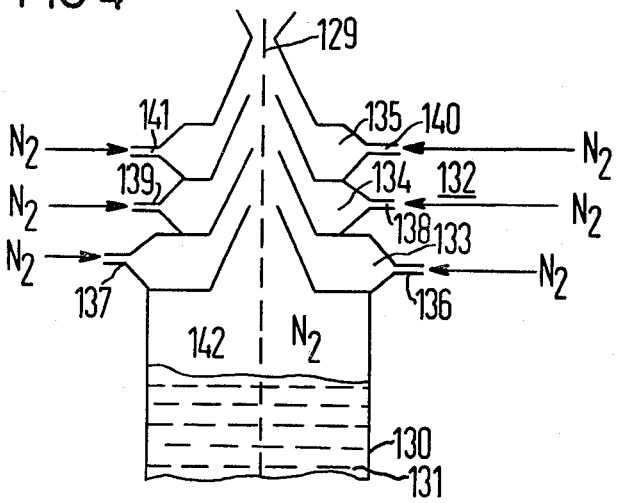
FIG. 4 illustrates one embodiment of an input head for a vertical through-flow aluminization cell of the type shown in FIG. 3.

FIG. 4 illustrates an input head suited for use in the mode of vertical operation of the galvano-aluminization system where the material 129 to be treated flows in a downwards direction as indicated by a broken line. A tubular cell 130 contains an electrolyte 131. The tubular cell 130 is adjoined by an airlock arrangement 132 which consists of at least three central chambers 133 to 135 of lamellar construction. These chambers are subject to an inert gas excess pressure which is above or below the other atmosphere in accordance with the input speed of the material 129 to be coated. As can be seen from the drawing, the chambers 133 to 135 are supplied with inert gas, for example, $N_2$, via connecting conduits 136 to 141. The tubular cell 130 above the electrolyte 131 contains the inert gas chamber 142. The chambers 133 to 135 and the inert gas chamber 142 can be subject to the same inert gas excess pressure or advantageously to an inert gas excess pressure which increases in an outwards direction (i.e. in an upwards direction) which produces an inert gas flushing jet action which cleanses the surface of the material 129 which is to be coated from adhering air or impure atmosphere and at the same time seals the galvano-aluminization system from the outer atmosphere.

The inert flushing jet action can be strengthened to any desired extent by employing more than three chambers. However, it can also be strengthened independently of the number of chambers by locating the chamber outlets towards the exterior (towards the top) increasingly close to one another, thus reinforcing the flushing jet action. Moreover, the blowing angle of the flushing jet can be modified by a different geometric shape for the chamber walls, and, as a consequence, its action can be optimized in accordance with the surface structure of the object to be coated.

Figure 5:
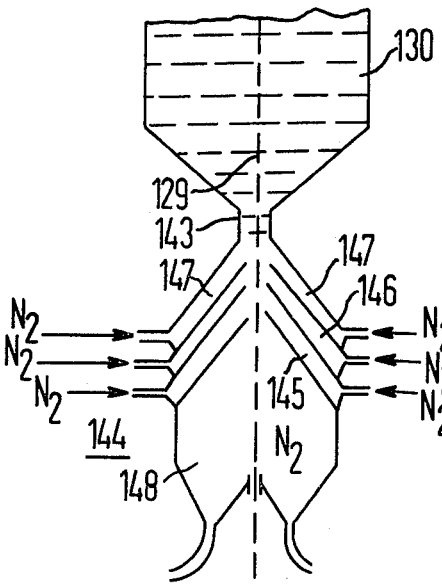
FIG. 5 illustrates one embodiment of a discharge head for a vertical through-flow aluminization cell of the type shown in FIG. 3.

FIG. 5 illustrates an output head suited for use in the mode of vertical operation in combination with the input head illustrated in FIG. 4. Similar components to those in the input head have been provided with the like reference numerals. At the lower end of the tubular cell 130 there is arranged a constriction 143 which is preferably matched to the cross-section of the material 129 to be treated and which is adjoined by an inert gas airlock arrangement 144. In the same way as the input head shown in FIG. 4, the inert gas airlock arrangement 144 consists of at least three central chambers 145, 146 and 147 constructed in lamellar form each of which is supplied with inert gas via connecting pieces (not shown in detail) as illustrated in FIG. 5. An inert gas chamber is also arranged beneath the chambers 145 to 147.

Figure 6:
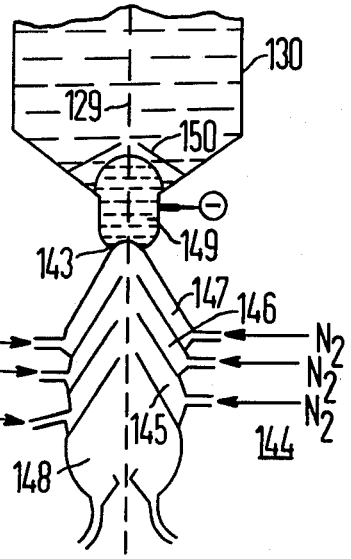
FIG. 6 illustrates another embodiment of discharge head for a vertical through-flow aluminization cell of the type shown in FIG. 3.

FIG. 6 illustrates an embodiment of an output head which reliably prevents inert gas entering the tubular cell 130. Parts which function in an identical manner to those of the output head of FIG. 5 or the input head of FIG. 4 have been provided with the same references as in FIGS. 5 and 4. In this construction, above the constriction 143 a chamber 149 is formed by an appropriate shaping of the lower end of the tubular cell 130 which is filled, for example, with a liquid metal such as, for example, gallium. The chamber 149 is screened from the tubular cell 130 by diaphragms 150. Here, the liquid metal is expediently used to electrically contact the object 129 which is to be coated.

The fundamental principle of the output heads illustrated in FIGS. 5 and 6 is that the inert gas pressure of the chambers 145 to 147 maintains the column of electrolyte liquid in a state of equilibrium to prevent it from escaping. This involves as narrow as possible discharge diaphragms for the object to be coated and is dependent upon manometric control of the output head. In comparison to the construction shown in FIG. 5, the construction in FIG. 6 has the advantage that electrolyte 131 still adhering to the galvanized material 129 is squeezed off by the liquid metal.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth in the hereto-appended claims.

We claim:

1. Apparatus for the continuous galvanic deposition of aluminum onto elongated material in the form of wire, strips, tubing, and the like from an aprotic organoaluminum liquid electrolyte which is free from oxygen and water, said apparatus coamprising:

a generally elongated cell having generally tubular side walls, and having opposed outermost end portions, said cell being adapted for the passage longitudinally therethrough of said elongated material, a pair of connecting components, each one being associated with a different respective end portion of said elongated cell, each one of said connecting components further including:

a longitudinally extending generally tubular portion and a generally transversely extending generally tubular portion which is abuttingly interengaged at one end thereof with a mid portion of said longitudinally extending portion to define an entrance therebetween, guide means associated with at least a longitudinally outermost end portion of said longitudinally extending portion, said guide means having longitudinally extending therethrough a passageway for the passage therethrough longitudinally of said elongated material, said guide means further having a longitudinally innermost terminal face that extends angularly across said longitudinally extending generally tubular portion, said terminal face being adapted to deflect flow of said electrolyte angularly relative to said longitudinally extending generally tubular portion, a pair of airlocks means, each one being associated with said longitudinally outermost end portion of a different one of said pair of connecting components, each one of said airlock means further including transversely extending diaphragm means having diaphragm channel means defined therein for the passage therethrough longitudinally of said elongated materials, said channel means being adapted to substantially prevent air from entering into said cell as said elongated material moves therethrough, an electrolyte closed circulation means, including an electrolyte reservoir container means, a pump means, and conduit means interconnecting said reservoir means with said generally transversely extending generally tubular portion for circulating said electrolyte through said elongated cell, and through said conecting means, electrode means, insulation means and conduction supply means therefor associated with said elongated cell and arranged to provide an electric field in said cell when filled with said electrolyte and said elongated material is so passed therethrough.

2. The apparatus of claim 1 wherein in each of said connecting components there is additionally provided a tube-like projection means which, extends from said innermost terminal face along the longitudinal axis of at least a portion of said longitudinally extending tubular portion that is not associated with said guide means and which tube-like projection means has longitudinally extending therethrough a channel that is generally longitudinally aligned with said passageway for the longitudinal passage through both said channel and said passageway of said elongated material.

3. The apparatus of claim 1 wherein, in each of said connecting components, there is additionally provided terminal flange means associated with said longitudinally extending tubular portion for attaching the associated said connecting component to said elongated cell.

4. The apparatus of claim 1 wherein said electrode means includes anode plates which extend longitudinally within said elongated cell along generally opposing longitudinal sides of said elongated material with supporting insulation means being present to hold said anode plates in spaced relationship relative to said elongated cell.

5. The apparatus of claim 1 wherein, in each of said airlock means, a plurality of longitudinally spaced diaphragm means are provided with a chamber being defined between each longitudinally adjacent pair of such diaphragm means.

6. The apparatus of claim 5 wherein at least one of said diaphragm means is provided with pipe means for applying an inert fluid upon said elongated material as such moves through such diaphragm channel means therein.

7. The apparatus of claim 1 wherein said elongated cell and said reservoir container means are provided with insulative heating jacket means for heating said electrolyte

8. The apparatus of claim 1 wherein thermometer means are arranged at opposite ends of said elongated cell for measuring temperature differences which occur in the flow direction of said electrolyte.

9. The apparatus of claim 1 additionally including an inert liquid circulation means, including an inert liquid reservoir means, a pump means, and conduit means interconnecting said reservoir means with said generally transversely extending generally tubular portion for circulating said inert liquid through said elongated cell and through said connecting means.

10. The apparatus of claim 1 wherein said electrolyte closed circulation means additionally includes in each one of said pair of airlock means a defined chamber means on respective portions thereof in adjacent association with the associated one of said pair of connecting means, for receiving thereinto those quantities of excess said electrolyte which longitudinally pass through said passageway and said electrolyte closed configuration means additionally includes conduit means for leading said excess electrolyte back into said electrolyte reservoir container means.

11. The apparatus of claim 10 wherein that airlock means on said pair of airlock means through which said elongated material moves after such has passed through said elongated cell is additionally provided with spraying means for applying an inert liquid to said elongated material, said spraying means including chamber means for collecting resulting inert liquid so applied.

12. The apparatus of claim 11 wherein said spraying means includes distillation means for treating a portion of said electrolyte and thereby separating therefrom an inert liquid, pump means for delivering said inert liquid to said spraying means, and conduit means for conducting said inert liquid to said spraying means and for conducting said resulting inert liquid back into said electrolyte reservoir container means.

13. The apparatus of claim 1 further including insulating means for electrically separating an electric field produced by said electrode means from other components of said apparatus when said electrolyte is flowing through said elongated cell and said connecting components and said elongated material is moving through said elongated cell, said airlock means and said connecting components.

14. The apparatus of claim 1 oriented vertically.

15. The apparatus of claim 14 wherein, in each of said airlock means, a plurality of longitudinally spaced diaphragm means are provided with a chamber being defined between each longitudinally adjacent pair of such diaphragm means, wherein at least one of said diaphragm means is provided with pipe means for applying an inert fluid upon said elongated material as such moves through such diaphragm channel means therein, and wherein each of said airlock means additionally includes inert gas supply means whereby said inert fluid is conducted upwards.

16. The apparatus of claim 15 wherein each of said airlock means has at least three of said chambers and wherein such diaphragm means are arranged in lamellar form.

17. The apparatus of claim 14 wherein liquid seal means is provided in a lower end portion of said elongated cell.

18. The apparatus of claim 16 wherein said liquid seal comprises a liquid metal through which said elongated material can pass.

* * * * *